United States Patent [19]

Bartholomew

[11] Patent Number: 4,895,124

[45] Date of Patent: Jan. 23, 1990

[54] FUEL AND ELECTRICAL DISTRIBUTION SYSTEM FOR FUEL INJECTED ENGINES

[75] Inventor: Donald D. Bartholomew, Marine City, Mich.

[73] Assignee: Proprietary Technology, Inc., Mt. Clemens, Mich.

[21] Appl. No.: 127,378

[22] Filed: Dec. 2, 1987

[51] Int. Cl.[4] ..... F02M 39/00

[52] U.S. Cl. ..... 123/510; 123/451; 123/468; 123/514

[58] Field of Search ..... 123/510, 512, 514, 516, 123/357, 358, 359, 41.31, 468, 469, 470, 471, 472, 451

[56] References Cited

U.S. PATENT DOCUMENTS

| | | | |
|---|---|---|---|
| 2,913,231 | 11/1959 | Powell et al. . | |
| 3,412,718 | 11/1968 | Long . | |
| 3,776,209 | 12/1973 | Wertheimer et al. . | |
| 4,084,564 | 4/1978 | Rickert | 123/41.31 |
| 4,205,637 | 6/1980 | Ito et al. . | |
| 4,294,215 | 10/1981 | Hans et al. . | |
| 4,364,355 | 12/1982 | Karino | 123/41.31 |
| 4,474,159 | 10/1984 | Katnik . | |
| 4,510,909 | 4/1985 | Elphick et al. . | |
| 4,512,893 | 8/1985 | Day | 123/41.31 |
| 4,539,961 | 9/1985 | Atkins | 123/516 |
| 4,543,914 | 10/1985 | Harris | 123/357 |
| 4,552,311 | 11/1985 | Casey . | |
| 4,570,601 | 2/1986 | Ito et al. . | |
| 4,570,602 | 2/1986 | Atkins et al. . | |
| 4,583,508 | 4/1986 | Schechter . | |
| 4,601,275 | 7/1986 | Weinard | 123/516 |

*Primary Examiner*—Carl Stuart Miller

*Attorney, Agent, or Firm*—Harness, Dickey, Pierce

[57] ABSTRACT

A fuel injection system for use with internal combustion engines has a module adapted to be remotely positioned away from the internal combustion engine within the engine compartment. The module includes a fuel inlet and return for moving fuel from a fuel source to the module. A second fuel return associated with the first fuel return is adapted to enable fuel to enter from the module to the fuel injectors of the internal combustion engine. The module further includes an electronic mechanism and harness for controlling and distributing fuel to and from the module and injectors.

5 Claims, 4 Drawing Sheets

Fig-6
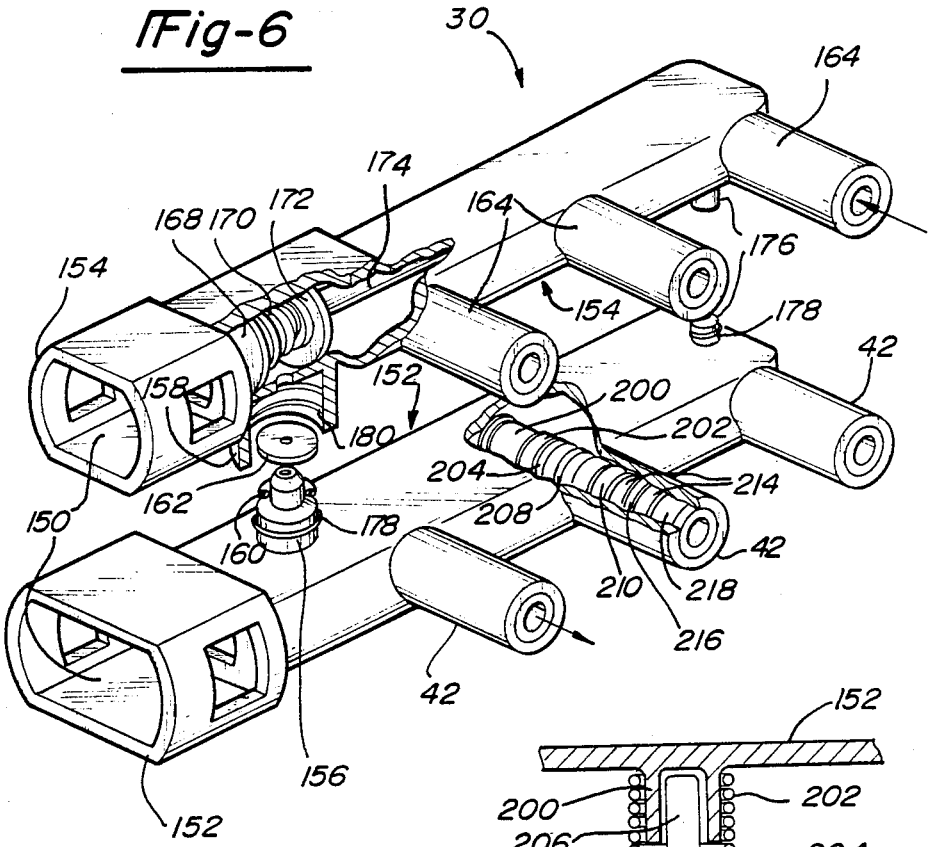
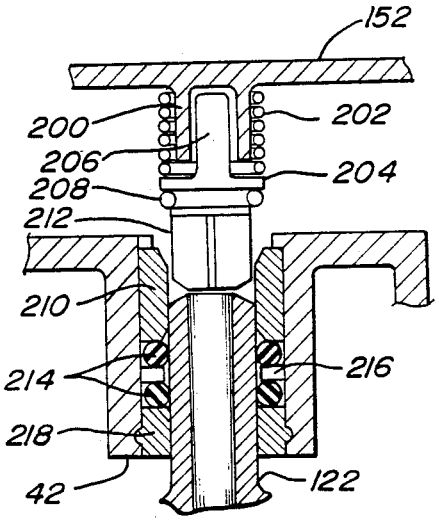
Fig-6A

FUEL AND ELECTRICAL DISTRIBUTION SYSTEM FOR FUEL INJECTED ENGINES

BACKGROUND AND SUMMARY OF THE INVENTION

In modern automotive engines fuel management is accomplished by use of electrically controlled fuel injectors that spray fuel into the air/fuel induction system. The injectors are operated for short periods of time that are determined by a system of sensors and usually a computer which responds to the sensed information and appropriately operates the injectors. It is common practice to have fuel pressure applied to the injectors continuously so that the fuel is controlled at the injectors. It is necessary that the fuel available at the injectors be maintained at a stable pressure and flow availability so that additional sensors of fuel pressure are not required at the injectors to maintain good control of the amount of fuel flowing through an injector when the injector is opened. It is also important that the valve portions of the injector stay wet with fuel to prevent drying of the seals and to lubricate the injector mechanical structure.

The concept disclosed herein provides a means by which these requirements are met by using a module that is remotely mounted away from the injectors such that fuel inlet and outlet passages and the electrical control wiring are contained in leads that communicate from this module to each injector. The module, being remotely mounted, may be in an environment that is more tolerant with regard to temperature and vibration for the electrical and fuel pressure management functions. Additionally, the module may be constructed of plastic materials to lower the cost, provide a single device for testing and qualification prior to installation, and provide a fuel reservoir means, by virtue of the leads, where the injectors are always "wet". Since only small diameter leads communicate between the module and the injectors, packaging of the fuel and air induction systems are simplified, and the reduced mass of the system mounted on the engine reduces failures associated with accelerations of the mass mounted on the engine. Remotely mounting the module also facilitates the prevention of air entrapment causing air pockets that may travel to the injectors, or prevent proper regulation of the fuel pressure. This is easily accomplished in a module environment manifolds, communicated by a passage and orifice which allows by constructing two air entrained or trapped in the fuel source portion to bleed directly into the return line on the downstream return side of a fuel pressure regulator mounted in the return manifold which maintains pressure applied to the injectors. Since the fuel flow is much greater than the actual fuel use in these systems, this continuous bleeding orifice which passes little fuel but a lot of air does not adversely affect fuel system pressure unless a large volume of air arrives at the bleed point. In any case, the adverse effect is much less than having this air trapped in a fuel rail. The remotely mounted module also provides convenient connections of lines from the tank which may be of a lower temperature resistance less costly material. Also, if desired a filter may be combined with the module for easy servicing.

In practice such a module has many benefits for the user:

(a) A single fuel management device which is easily qualified electrically and for fuel pressure.

(b) The ability to easily deal with entrained air.

(c) Ease and reliability of connecting fuel and electrical junctions to the injectors that have been adapted to this type system.

(d) More flexibility in air/fuel induction systems to the engine, less space required, few constraints in design, optimized location and aiming of injectors.

(e) Standardization of many components of the present system that leads to lower cost and better reliability.

(f) Reduction of assembly time, improved assembly reliability.

(g) Improved diagnostics and repairing capabilites, remove and replace one device.

(h) A system which is "fail safe" from a fuel connection standpoint, check valves at outlets are pressure manifold injector connections.

(i) In car fuel system pressure check without injector leakage.

(j) Individual injectors are easily checked or replaced.

DETAILED DESCRIPTION OF THE INVENTION

The adoption of this concept requires a repackaging of fuel injectors so that they are:

(1) Easily connected by the leads from the module.

(2) Easily individually secured to the intake manifold.

This can also better achieve proper "aiming" of the injector spray.

The module itself may be mounted on portions of the car body, or air intake system that are above the injectors (in order that optimum air bleeding control is effected). These areas would include fender liners, hood, firewall, air ducting, etc., and would ideally (if possible) be areas such that if there were a fuel leak, the leaking fuel would be obvious and pose no immediate danger. Present systems do not in general meet this criteria because of their different design concept.

The concept also allows packaging of check valves into the pressurized line portions of the system so that if the connector to the fuel distribution harness (to each injector from the module) form the module is not properly "made", no streaming leak will occur from the module when the fuel pump is turned on.

Also it is possible to design a check valve into the connector that is attached to each injector to prevent a streaming leak in the event that the connection to the injector is improperly "made". These check valves would be "opened" by properly attaching the connectors.

There are many ways the disclosed concept may be implemented. The figures that follow are intended to show one embodiment of the concept of combining the fuel pressure control, electrical and fuel connections including portions of the electrical control dealing with entrapped air, and making unit connections of electrical and fuel source and return to individually mounted injectors.

BRIEF DESCRIPTION OF THE DRAWINGS

FIGS. 6, 6A and 6B show the fuel connection portion of the fuel and engine management module with air bleed and check valve details.

DETAILED DESCRIPTION OF THE INVENTION

Figure 1:
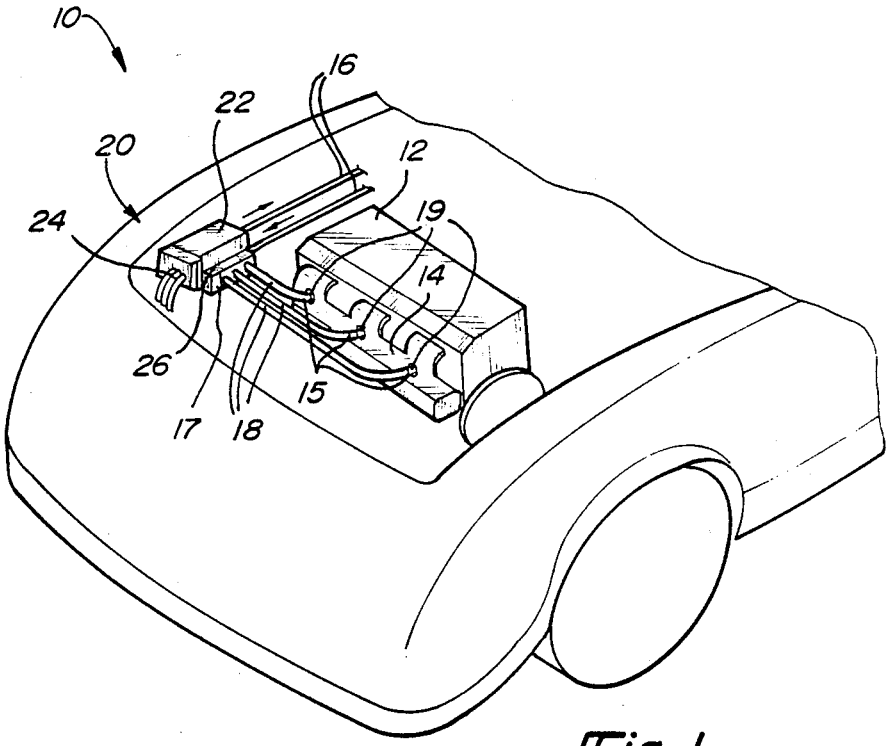
FIG. 1 shows the fuel and engine management module mounted in the engine compartment of an automobile.

Referring to FIG. 1, the engine compartment of an automobile 10 is shown. The fuel and engine management module installation 20 is shown, with module 22 being connected to the injectors 19 which are mounted to the air induction system 14 which is mounted to the engine 12. Connection to the injectors 19 as made via a distributor harness 18. Distributor harness 18 is connected to the module 22 via a plug 17 which includes the electrical and fuel connecting capability. The electrical portion is shown as pigtail 25 and plug 26 at the end of pigtail 25. Fuel is conveyed to and from module 22 by fuel source and return lines 16, and fuel and electric power to operate injectors 19 are carried to each injector 19 and connected by a plug 15 at the end of each harness 18 lead. Connector 24 brings power and the signals from sensors to the computer which is also in module 22.

Figure 2:
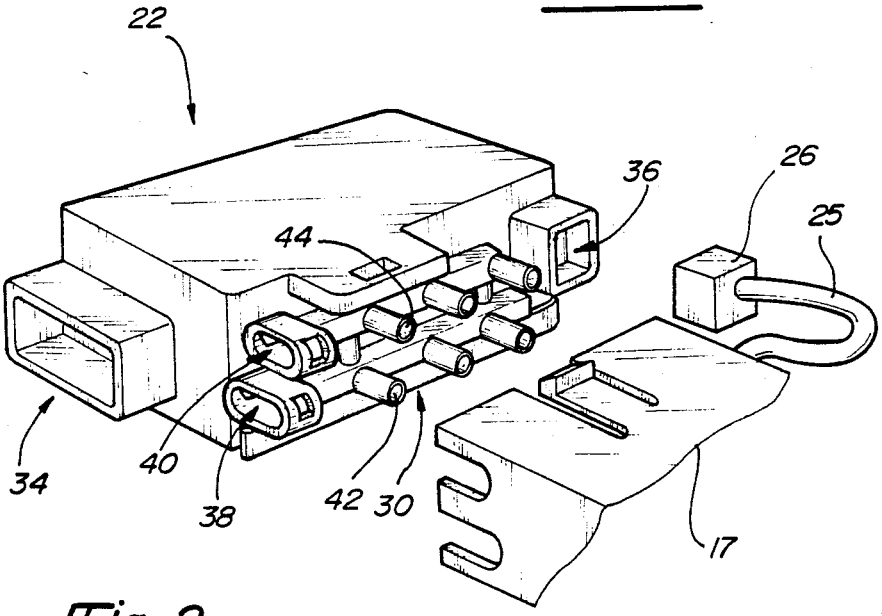
FIGS. 2 and 2A show the fuel and engine management module with the various connecting points.
Figure 2A:
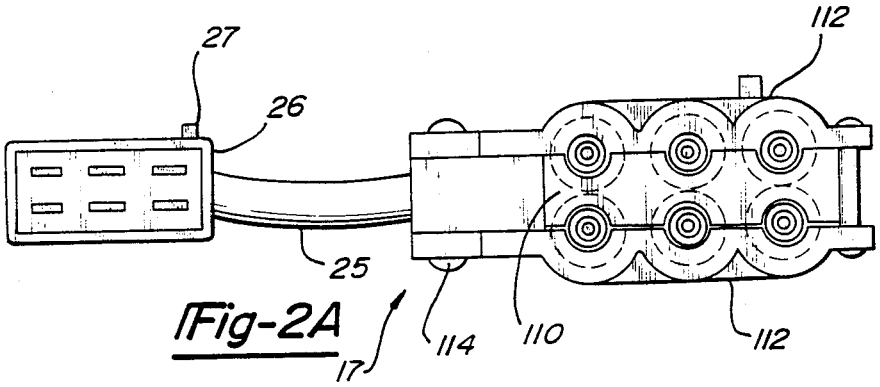

FIG. 2 show module 22 and the fuel distribution, fuel pressure, and air bleed portion 30, which is attached to, or is a part of the module, electrical connection 34 which receives connector 24, and electrical connection 36 which receives connector plug 26 which is part of distribution harness 18 plug 17. The fuel pressure source inlet 38, and return 40 are connection points for source and return lines 16. The fuel outlet nipples 42 are provided with check valves which seal the outlet flow of fuel source unless plug 17 is properly installed. The fuel return from connectors 15 are to return ports 44.

Figure 3:
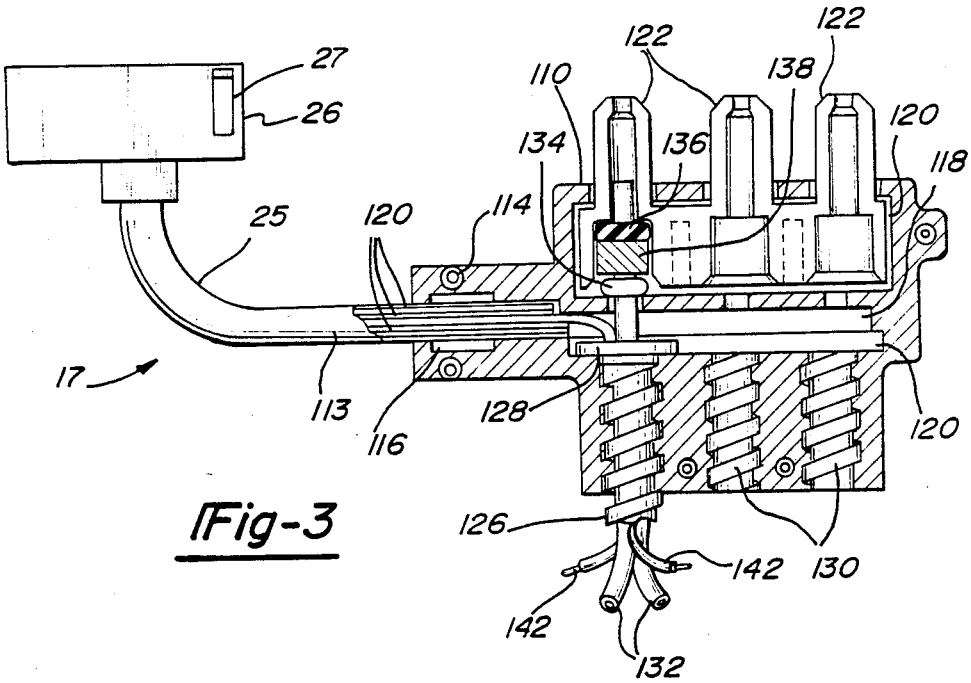
FIG. 3 shows the upper end of the fuel/electric distribution harness.

FIG. 3 shows the plug 17 which plugs into the module 22. The electrical plug 26 may have a key 27 to cooperate with receptacle 36. Plug 17 consists of a center double tray portion 110 and covers 112 which are attached by rivets 114 or mushroomed ends of pins molded as part of center portion 110. center portion 110 contains various pockets and troughs 116 for the pigtail 25 wire and cover cinch 113 to receive the wires 120 to receive the male port pins 122 and 124 to receive lead conduit 126 bushings 128. The conduits 126 fit into pockets 130. The tubes (source and return) 132 are held by a bead 134, and O-rings 136 are held in the male and end pins adapter 122 by bushing 138. Cinch 140 fixes wires 142. A key 144 may be used to orient plug 17 relative to module 22.

Figure 4:
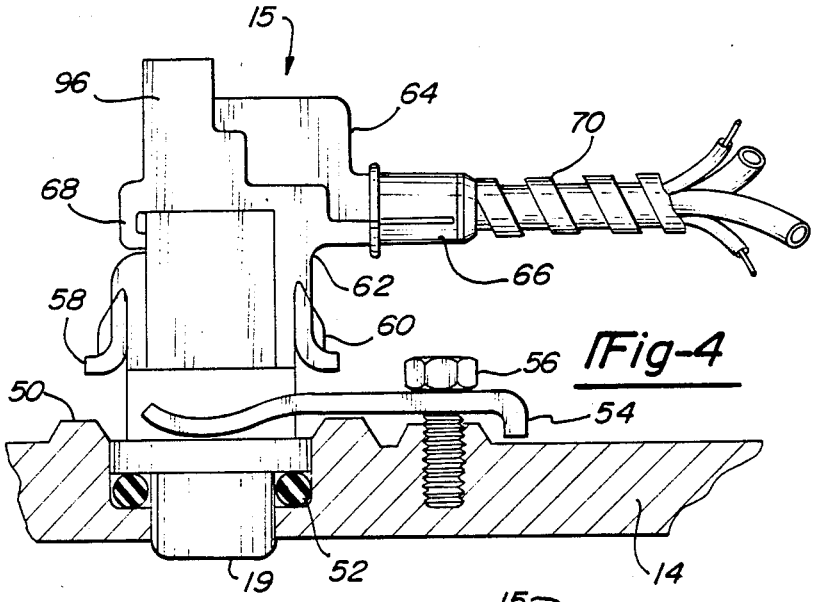
FIG. 4 shows one lead of the fuel/electric distribution harness connected to an injector which is mounted in the air induction manifold.

FIG. 4 shows connector 15 attached to injector 19 which is mounted into air induction manifold 14. The injector 19 is mounted in port 50 of manifold 15 and is sealed by O-ring 52. The injector 19 is secured in port 50 by clamp 54 which is held down by bolt 56. FIG. 4 also shows external features of connector 15. Connector 15 is secured to injector 19 by latches 58 which engage lugs 60. Body 62 of the connector has cap 64 partially secured by clamp 66, and engagement 68, so that the lead 70 of distributor harness 18 is secured to connector 15.

Figure 5:
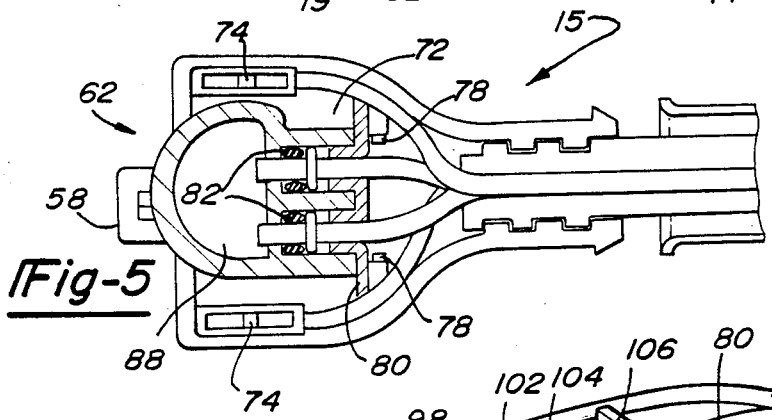
FIGS. 5, 5A, 5B show some details of the injector connector at the injector end of the fuel/electric distribution harness.
Figure 5A:
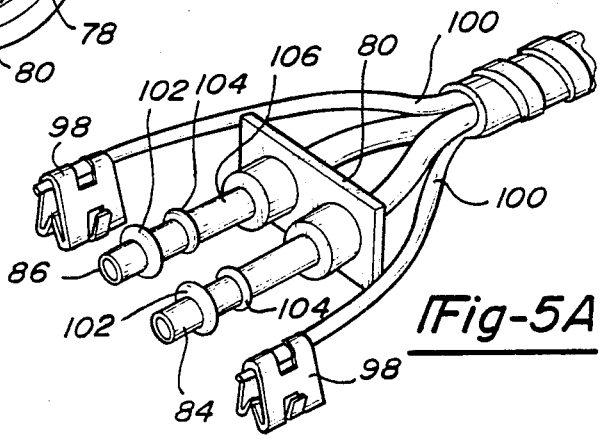
Figure 5B:
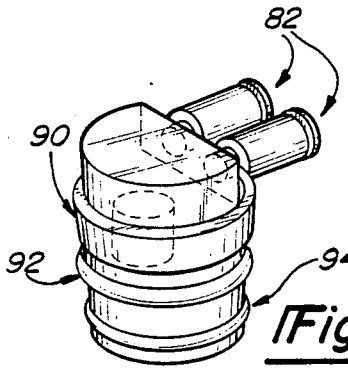

FIGS. 5, 5A, and 5B show some of the internal features of connector body 62. The internal structure of body 62 provides a tray area 64 which provides mounting area 74 for injector 19 electric power, bosses 78 to locate tube and seal retainer 80 in ports 82 for the fuel source 84 and return 86 lines. Connector body 62 also contains a port 88 for a check valve (not shown) and provisions for retaining a spacer 90, O-ring 92, and snap-in bushing 94. Tower 96 on cap 64 accommodates the check valve port 88.

Terminals 98 attached to wires 100 snap into mounting areas 74. O-rings 102 are mounted on tube ends 84 and 86. This method of sealing does not suffer from potential leakage that would be experienced if the O-rings were mounted on the other side of beads 104 in the process claiming area 106. Tube and seal retainer 80 is mounted prior to the forming of beads 104. When all parts are assembled and tested cap 64 is attached to body 62. Cap 64 may be sealed to body 62 by means not shown.

FIGS. 6 and 6A show some of the features of the fuel distribution, air bleed, and ports portion 30 which is shown separated from module 22 for clarity. Source ports 42 contain check valves as shown in FIG. 6A. The connector internal parts for source and return lines 16 that go into connection ports 150 are not shown. The source portion 152 is positioned below the return portion 154, so that any air entrained in the source fuel can escape up port 156 in to the return section 154. Port 156 on the source portion 152 is sealed to port 158 of the return portion 154 by means of seal 160. Orifice washer 162. The orifice hole dimensions are chosen so as to by-pass a small amount of fuel but large amounts of air. In practice ports 156 and 158 would be reversed so that a larger air collection volume is obtained, but they are as shown in the figure for clarity. The return portion 154 has female ports 164 which are constructed in a manner similar to ports 42 of the source portion 152. The return ports 164 do not need to include check valves, although they may if desired. An important feature of the return portion is a system pressure regulator provided by elements 168, 170, 172, and 174. Bushing 168 snaps into the return portion 154 housing and includes means for adjustable biasing of spring 170 which drives valve stem 174 to the seat at area 12 of the housing 154. Spring 174 bottoms on the adjustable portion of bushing 168.

A second pin and port 176 may be constructed as port 156 and 158 if desired. The source and return sections may be easily locked together by use of the lock ring bead 178 which snaps into a groove 180 which is provided for that purpose.

FIG. 6A shows a section of the source portion 152 with a boss 200 that locates a spring 202, and guides valve 204 via pin 206. O-ring 208 carried by valve 204 seals on snap-in bushing 210 which also guides stem 212. Male end 122 is also guided by bushing 210, and sealed by O-rings 214, which are separated by spacer 216. These parts are secured by snap-in bushing 218, which also guides male 122. Connection of plug 17 causes male port pins 122 to engage stem 212 of valve 204, and open valve 204 so that plug 17 is communicated to the source fuel in portion 152.

What is claimed is:

1. A fuel injection system for use with internal combustion engines comprising:

a module adapted to be remotely positioned away from the internal combustion engines in an engine compartment, said module including:

fuel inlet and return means adapted for connecting with a fuel source and return such that fuel is pumped to said module fuel inlet means from said source and fuel is returned from said module fuel return means to the fuel return; fuel outlet means associated with said fuel inlet means, said fuel outlet means adapted to enable fuel to pass from the module to fuel injectors of the internal combustion engines;

second fuel return means associated with said first fuel return means, said second fuel return means adapted to enable fuel to enter the module from the fuel injectors of the internal combustion engines;

electronic means for controlling fuel distribution to and from the fuel injectors, said electronic means adapted to be associated with the fuel injectors for controlling fuel entering into the internal combustion engines; and harness means adapted for distributing fuel to and from the module to and from the fuel injectors such that said harness means is adapted to couple with said fuel outlet means and said second fuel return means and for coupling said electrical means with the fuel injectors, said harness means is of a unitary construction.

2. The fuel injector system according to claim 1 further comprising means for regulating fuel pressure in said system, said pressure regulating means coupled with said module first return means.

3. The fuel injector system according to claim 1 wherein said harness means comprises a plurality of lines, each line including a fuel delivery conduit and fuel return conduit for supplying and returning fuel between the injectors and the module and electrical leads to couple the electric control means with the fuel injectors, said conduits are coupled with said module fuel outlet means and second fuel return means and said leads are electrically coupled with said module electronic means.

4. The fuel injector system according to claim 3 wherein said lines are adapted to readily connect with said module.

5. The fuel injector system according to claim 3 wherein said conduits include valves which enable flow when properly coupled with said module fuel outlet means and second fuel return means.

* * * * *